US005928039A

United States Patent [19]

Adler et al.

[11] Patent Number: 5,928,039

[45] Date of Patent: Jul. 27, 1999

[54] ELECTRICAL WIRE CONNECTOR

[75] Inventors: Kevin Meryle Adler, Harrisburg; Emerson M. Reyner, II, Palmyra, both of Pa.

[73] Assignee: The Whitaker Corporation, Wilmington, Del.

[21] Appl. No.: 09/065,510

[22] Filed: Apr. 28, 1998

Related U.S. Application Data

[60] Provisional application No. 60/045,659, May 6, 1997.

[51] Int. Cl.[6] ..... H01R 4/50

[52] U.S. Cl. ..... 439/783

[58] Field of Search ..... 439/783, 863

[56] References Cited

U.S. PATENT DOCUMENTS 4,415,222 11/1983 Polidori ..... 339/270 R
4,600,264 7/1986 Councel ..... 439/783
5,006,081 4/1991 Councel et al. ..... 439/783
5,145,420 9/1992 Counsel et al. ..... 439/783

*Primary Examiner*—Gary Paumen
*Assistant Examiner*—Antoine Ngandjui
*Attorney, Agent, or Firm*—Mary K. Van Atten

[57] ABSTRACT

The invention is directed to an electrical connector comprising a C-shaped member and a wedge member. The C-shaped member has a web defining a bottom and two arcuate ears extending therefrom and defining a path to receive two conductors therealong. The arcuate ears having a centerline extending through the center of the arc. The wedge member having two conductor receiving channels extending therealong. The channels having a centerline extending through the center of the arc of the channels. When the C-shaped member and the wedge member are assembled together, the centerline of the channels of the wedge is further from the bottom than the centerline for the arcuate ears.

5 Claims, 3 Drawing Sheets

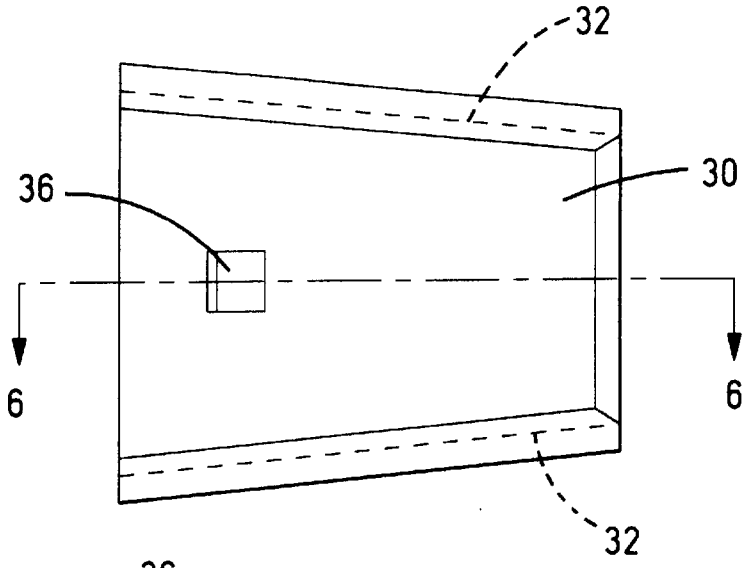
Fig. 5
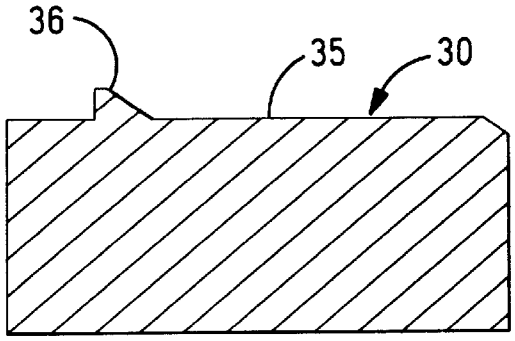
Fig. 6
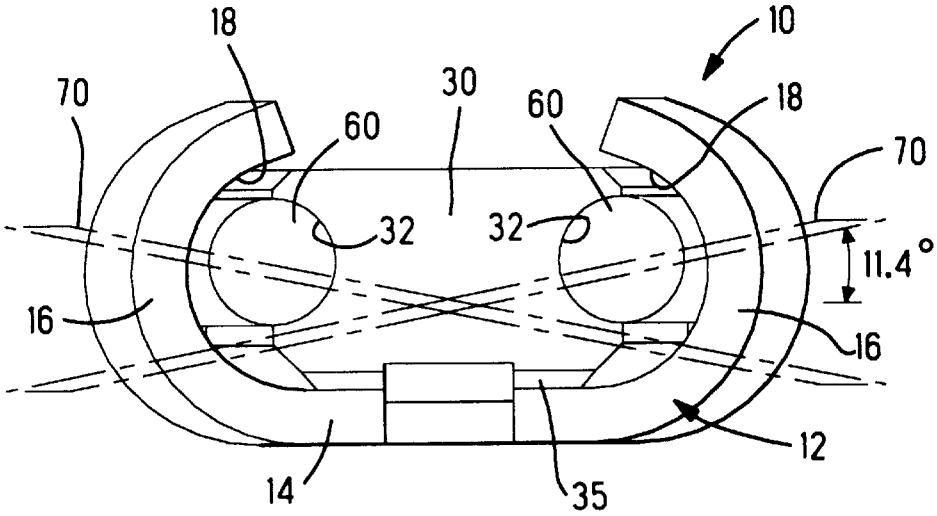
Fig. 7
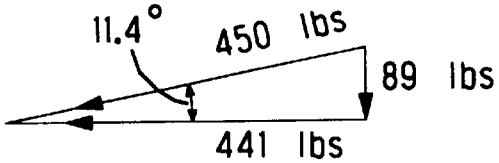

ELECTRICAL WIRE CONNECTOR

This Application claims benefit of Provisional Application 60/045,659 filed May 6, 1997.

FIELD OF THE INVENTION

The present invention relates to the field of electrical connectors and more particularly to electrical connectors commoning and mechanically securing two electrical wires.

BACKGROUND OF THE INVENTION

Electrical connectors of the type having a C-shaped body member having converging channels and a complementary wedge member have been know conventionally for many years and are disclosed for example in U.S. Pat. Nos. 4,415,222; 4,6600,264 and 5,006,081. Basically, two uninsulated conductors are electrically and mechanically connected by being pressed into and against interior curved surfaces or channels provided in a C-shaped body member by a wedge being driven longitudinally into the body member between the conductor. These known wedge connectors have been successfully used in the power utility industry for large diameter cable where the C-members are massive enough to exert a resilient, compressive force against the cables trapped in the channels by the wedge.

In U.S. Pat. No. 5,145,420, such a C-shaped wedge connector is disclosed for use with somewhat smaller diameter wire. The C-shaped member has a locking recess and the wedge member has a locking projection so that when the two are terminated, the locking projection will prevent the wedge from being removed from the C-member. The C-shaped member has arcuate ears with a centerline extending through the center of the arcuate ears. The wedge member has two conductor receiving channels which has a centerline extending through the center of the channels. When the connector is assembled, the centerline of the arcuate ears coincides with the centerline of the channels.

In other versions, the centerline of the arcuate ears is above the centerline for the channels. With this configuration, an additional frictional force component, which could be caused by the conductor rotation or other external cause could result in the wedge being moved away from the C-shaped member, thereby disengaging the latching mechanism. After disengagement of the latch, a small tensile force on the conductors can cause the connector to disassemble, thereby opening the circuit.

In certain circumstances, it may be possible to rotate the conductors, which have been terminated between the C-member and the wedge, thereby overcoming the frictional force that is holding the wedge within the C-member. In such a case, the wedge will pop up so that the locking projection is moved out of the locking recess and the wedge can pop out from between the conductors and the C-member.

What is needed is an electrical connector wherein the wedge is more securely held within the C-member. What is also needed is an electrical connector capable of withstanding severe conductor rotations without jeopardizing the latching mechanism.

SUMMARY OF THE INVENTION

The invention is directed to an electrical connector comprising a C-shaped member and a wedge member. The C-shaped member has a web defining a bottom and two arcuate ears extending therefrom and defining a path to receive two conductors therealong. The arcuate ears having a centerline extending through the center of the arc. The wedge member having two conductor receiving channels extending therealong. The channels having a centerline extending through the center of the arc of the channels. When the C-shaped member and the wedge member are assembled together, the centerline of the channels of the wedge is further from the bottom than the centerline for the arcuate ears.

BRIEF DESCRIPTION OF THE DRAWINGS

An embodiment of the present invention will now be described with reference to the accompanying drawings, in which:

FIG. 5 is an end view of an alternative embodiment of the wedge of the present invention;

FIG. 6 is a cross sectional view of the wedge of FIG. 5; and

FIG. 7 is a cross sectional view of the electrical connector having two conductors received therein.

DETAILED DESCRIPTION OF AN EMBODIMENT OF THE INVENTION

U.S. Pat. No. 5,145,420, which is herein incorporated by reference in its entirety, discloses an electrical connector having a C-shaped member and a wedge. The C-shaped member has a central web with two arcuate ears extending therefrom. The arcuate ears define a channel into which two conductors are to be received to be terminated. The C-shaped member converges from one end to the other end.

The wedge member has two channels extending along either side thereof. The channels which are complementary to the channels defined by the arcuate ears. The wedge member converges from one to the other end.

Two wires or conductors are inserted into the channels defined by the arcuate ears. The wedge is then forced between the two conductors by an external force, such as a pair of pliers. The interaction of the C-shaped member and the wedge provides a compressive force on the conductors thereby providing a good electrical and mechanical connection between the conductors.

The C-shaped member has a locking recess and the wedge has a locking projection. When the connector is terminated, the locking projection is received within the locking recess thereby securing the C-shaped member and the wedge together.

U.S. patent application Ser. No. 08/767,076, filed Dec. 16, 1996, which is herein incorporated by reference in its entirety, discloses an electrical connector wherein the C-shaped member has a resilient latch and the wedge has a recess. When the connector is terminated, the resilient latch is received within the recess thereby locking the C-shaped member and the wedge together.

Figure 1:
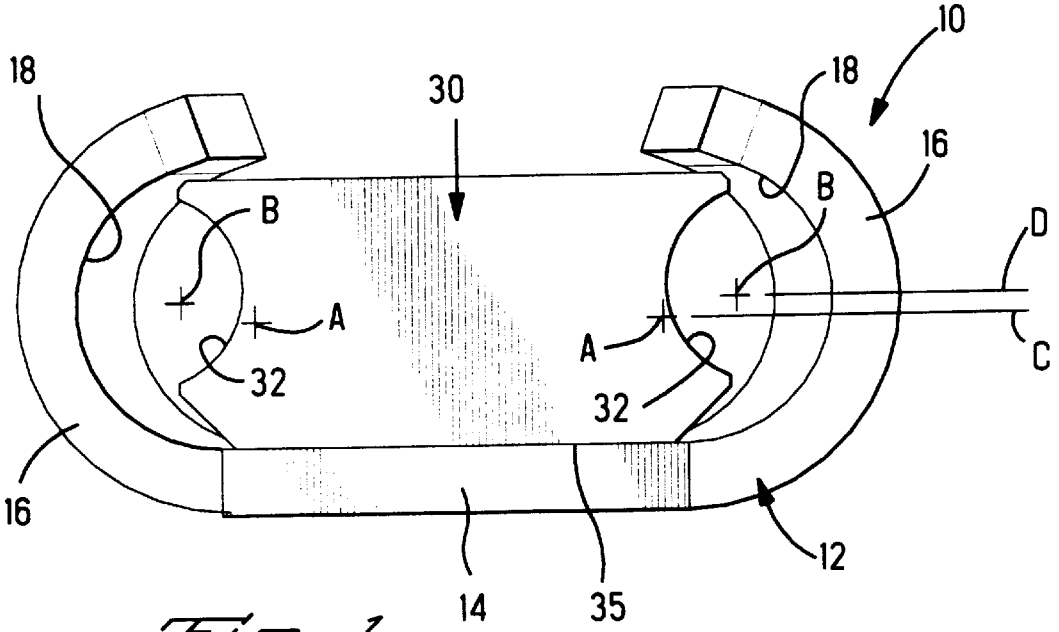
FIG. 1 is an end view of a the electrical connector of the present invention.

FIG. 1 shows an end view of the electrical connector of the present invention. The electrical connector 10 has a C-shaped member 12 having a central web 14 with two arcuate ears 16 extending therefrom. The arcuate ears 16 are semicircular, the center point of the semicircle being shown at A. The arcuate ears 16 each define a conductor receiving channel 18.

The electrical connector 10 has a wedge member 30 with a bottom surface 35 and two channels 32 extending along the sides of the wedge 30. The channels 32 are semicircular, the center point of the semicircle being shown at B. The channels 32, when in combination with C-shaped member 12 define conductor receiving channels.

When a line is drawn through the center points A of the arcuate ears 16, a centerline C for the C-shaped member is defined. When a line is drawn through the center points B of the channels 32, a centerline D for the wedge 30 is defined. FIG. 1 shows that the centerline for the wedge 30 is disposed higher than the centerline for the C-shaped member 12. The distance from the bottom surface 35 to the centerline D of the channels 32 is greater than the distance from the web 14 to the centerline C of the arcuate ears 16.

FIG. 7 shows the electrical connector 10 with two conductors 60 received within the conductor receiving channels between the C-shaped member 12 and the wedge 30. The vector lines 70 are drawn through the center points A, B, not shown in FIG. 7, of the arcuate ears 16 and the channels 32. Because the conductors 60 are loaded higher in the C-shaped member 12, the forces generated on the conductors 60 and also on the wedge 30 are directed downwardly, as viewed in FIG. 6. Because the forces are directed downwardly, that is towards the web 14, the wedge 30 is forced down into the C-shaped member 12, therefore making it much more difficult for the wedge 30 to pop upwardly so that the latching mechanism between the wedge 30 and the C-shaped member 12 becomes disengaged so that the wedge 30 can become dislodged from the C-shaped member 12. One such connector 10 produces 89 pounds of force directed downwardly on the wedge 30 to prevent the wedge 30 from becoming dislodged from the C-shaped member 12.

The Free Body Diagram, after assembly, shown in FIG. 7, illustrates the forces generated in the system. First, to determine the force vector, a line is drawn through the center point A of the arcuate ears 16 and through the center point of the conductor, which will coincide with the center point B of the channel 32, thereby creating a line normal to the tangent point of these two circles. This normal force is generated in a direction which forces the wedge 30 down, against the web 14, thereby engaging the latching mechanism. Furthermore, the components of this normal force and the friction coefficients between the C-shaped member 12, conductor 60, and wedge 30 are such that twisting the conductors 30 cannot create a frictional force greater than the downward force. Therefore, the latch mechanism cannot be defeated under normal field conditions.

Figure 2:
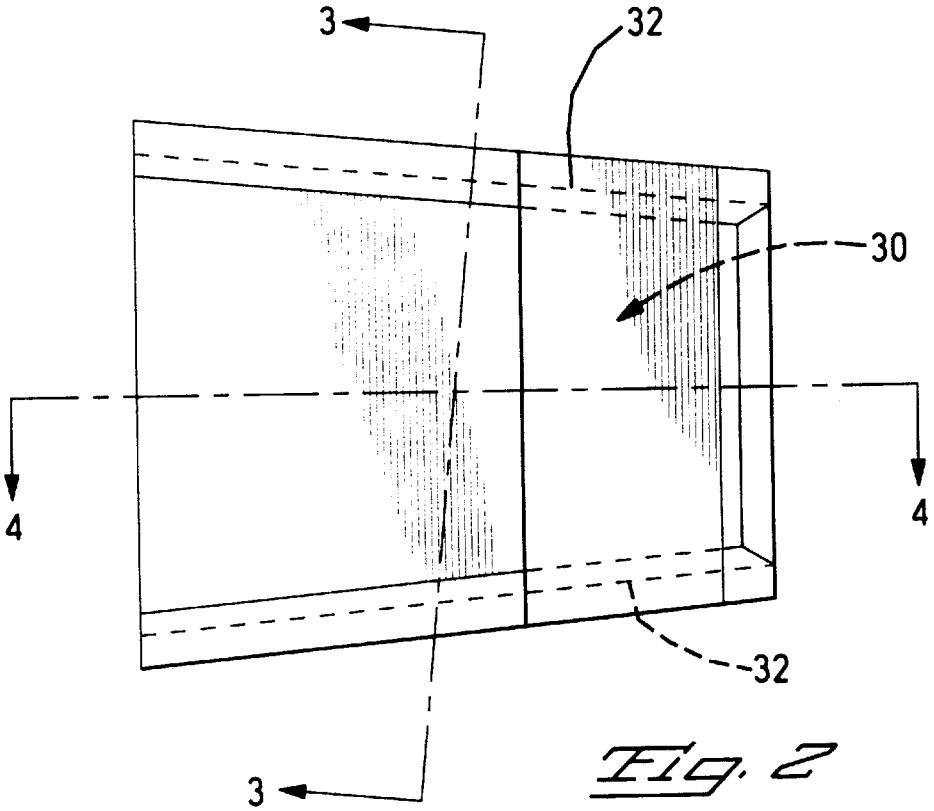
FIG. 2 is a top view of one embodiment of the wedge of the present invention.
Figure 3:
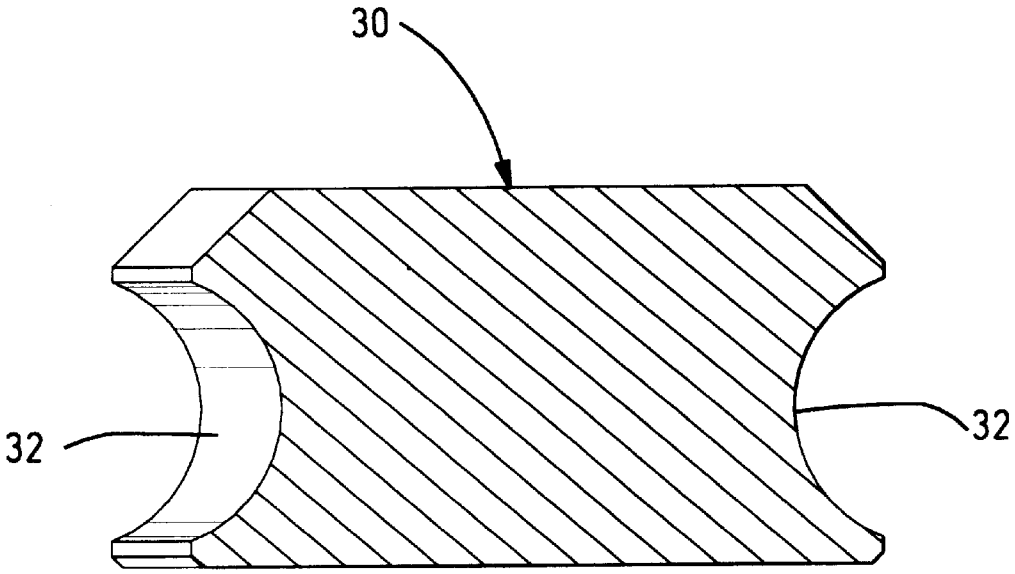
FIG. 3 is a cross sectional view of the wedge.
Figure 4:
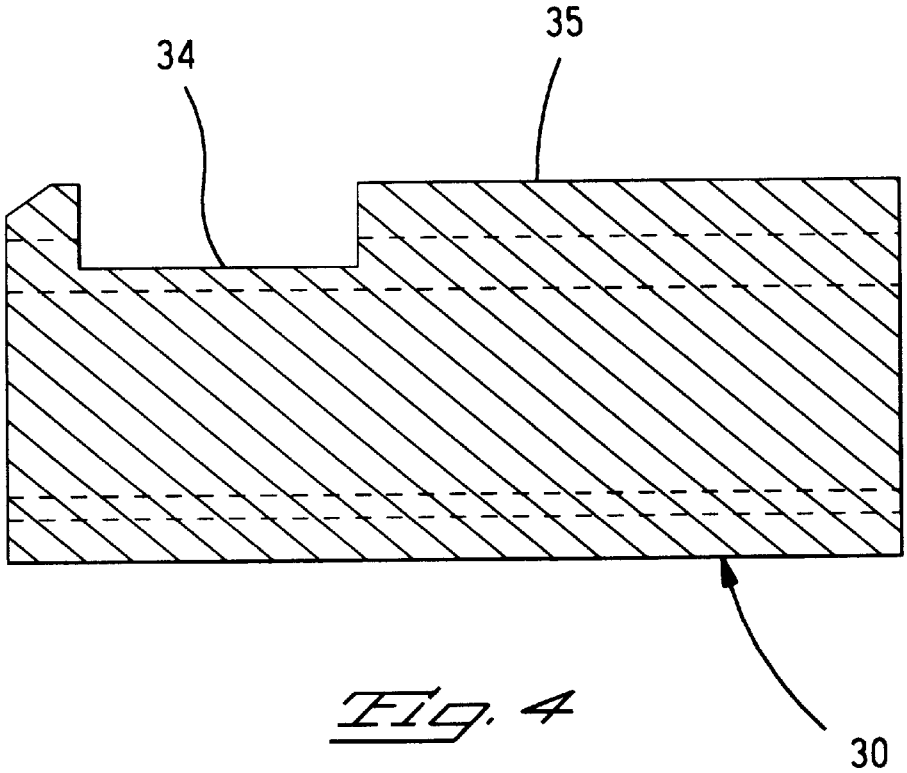
FIG. 4 is a cross sectional view of the wedge.

FIG. 2 shows a top view of one embodiment of the wedge 30 of the present invention. The wedge 30 has the channels 32 extending along either side of the wedge 30. FIG. 3 shows a cross sectional view of the wedge 30 showing the channels 32. FIG. 4 shows another cross sectional view showing the latching feature of one embodiment of the invention. The wedge 30 has a latching recess 34 received along a bottom surface 35 thereof. The latching recess 34 is designed to receive a resilient finger disposed on the C-shaped member 12, as shown in U.S. patent application Ser. No. 08/767,076, filed Dec. 16, 1996, to secure the wedge within the C-shaped member 12.

FIG. 5 shows an alternative embodiment of the wedge 30 of the present invention in which like features will have like reference numerals. The wedge 30 has channels 32 extending along sides thereof. The wedge 30 has a latching protrusion 36 disposed along the bottom surface 35. The latching protrusion 36 is designed to be received within a latching recess, as is shown in U.S. Pat. No. 5,145,420, to latch the wedge 30 within the C-shaped member 12.

Either latching feature for the wedge 30, shown in FIGS. 4 or 6, can be used with an appropriately designed C-shaped member 12 with the appropriate complimentary latching feature. Both wedges shown in FIGS. 4 and 6 have the centerlines of the channels 32 at a higher position than the centerlines of the arcuate ears 16.

The electrical connector of the present invention and many other attendant advantages will be understood from the foregoing description. It is apparent that various changes may be made in the form, construction, and arrangement of parts thereof, without departing from the spirit or scope of the invention or sacrificing all of its material advantages.

What is claimed is:

1. An electrical connector comprising a C-shaped member and a wedge member, the C-shaped member having a web defining a bottom and two arcuate ears extending therefrom and defining a path to receive two conductors therealong, the arcuate ears having a centerline extending through the center of the arc, the wedge member having two conductor receiving channels extending therealong, the channels having a centerline extending through the center of the arc of the channels, when the C-shaped member and the wedge member are assembled together, the centerline of the channels of the wedge is further from the bottom than the centerline for the arcuate ears, such that when the C-shaped member and the wedge are assembled with the conductors secured therein, the forces are directed from the centerline extending through the channels of the wedge toward the centerline extending through the arcuate ears, and push the wedge toward the bottom of the C-shaped member to keep the wedge secure within the C-shaped member.

2. The electrical connector of claim 1, wherein the C-shaped member has a forward end and a rearward end and the C-shaped member converges from the forward end to the rearward end.

3. The electrical connector of claim 2, wherein the wedge has a forward end and a rearward end and the wedge converges from the forward end to the rearward end.

4. The electrical connector of claim 1, wherein the wedge has a latching member and the C-shaped member has a complementary latching member to engage the latching member on the C-shaped member and the secure the wedge within the C-shaped member.

5. An electrical connector comprising a C-shaped member and a wedge member, C-shaped member having a web defining a bottom with an inner surface and two arcuate ears, the wedge member having two conductor receiving channels, each with an arc, the channels having a centerline extending through the center of the arc of the channels the wedge member having a bottom surface to the received against the inner surface of the C-shaped member, when the C-shaped member and the wedge are assembled, the centerline of the channels of the wedge is further from the bottom surface than the centerline for the arcuate ears is from the inner surface.

* * * * *